US006203470B1

(12) United States Patent
Lundin et al.

(10) Patent No.: US 6,203,470 B1
(45) Date of Patent: Mar. 20, 2001

(54) CHIN AND NECK EXERCISER WITH A VIBRATOR

(76) Inventors: Christopher B. Lundin, 18 Oliver St., Suite 204, North Easton, MA (US) 02356; Philip J. Tyne, 14999 Preston Rd., Suite 212-286, Dallas, TX (US) 75240

( * ) Notice: Subject to any disclaimer, the term of this patent is extended or adjusted under 35 U.S.C. 154(b) by 0 days.

(21) Appl. No.: 09/354,805

(22) Filed: Jul. 16, 1999

Related U.S. Application Data

(63) Continuation-in-part of application No. 09/016,778, filed on Jan. 30, 1998, now Pat. No. 5,971,890.
(60) Provisional application No. 60/065,414, filed on Nov. 12, 1997.

(51) Int. Cl.[7] ..... A63B 23/025; A61H 1/00
(52) U.S. Cl. ..... 482/10; 482/122; 482/128; 482/4; 601/39; 601/57
(58) Field of Search ..... 482/10, 122, 128; 601/39, 57; 473/595

(56) References Cited

U.S. PATENT DOCUMENTS

| | | | | |
|---|---|---|---|---|
| 749,147 | | 1/1904 | Aydelott . | |
| 1,051,896 | | 2/1913 | Kirkpatrick . | |
| 2,088,207 | | 7/1937 | Kaiser . | |
| 3,008,464 | | 11/1961 | Atkins . | |
| 3,413,243 | | 11/1968 | Griffin . | |
| 3,455,300 | | 7/1969 | Hayner . | |
| 3,497,217 | | 2/1970 | Feather . | |
| 3,727,607 | * | 4/1973 | Dill | 601/57 |
| 3,757,365 | | 9/1973 | Kretchmer . | |
| 4,153,248 | | 5/1979 | Holmes et al. . | |
| 4,285,081 | | 8/1981 | Price . | |
| 4,345,347 | | 8/1982 | Kantor . | |
| 4,454,253 | | 6/1984 | Murphy et al. . | |
| 4,617,691 | | 10/1986 | Monti et al. . | |
| 4,823,778 | | 4/1989 | Ewing . | |
| 5,005,826 | | 4/1991 | Merrick . | |
| 5,211,623 | | 5/1993 | Sarkozi . | |
| 5,344,437 | * | 9/1994 | Pistay | 607/109 |
| 5,484,359 | | 1/1996 | Wabafiyebazu . | |
| 5,496,026 | | 3/1996 | Montgomery . | |
| 5,501,646 | | 3/1996 | Miller . | |
| 5,507,718 | | 4/1996 | Kabat . | |
| 5,556,357 | | 9/1996 | Hanna . | |
| 5,588,168 | | 12/1996 | Byrne et al. . | |
| 5,626,545 | | 5/1997 | Newman et al. . | |
| 5,738,640 | | 4/1998 | Carlson-Orsi . | |
| 5,971,890 | * | 10/1999 | Tyne | 482/10 |

FOREIGN PATENT DOCUMENTS

| | | |
|---|---|---|
| 680572 | 9/1992 | (CH) . |

* cited by examiner

*Primary Examiner*—John Mulcahy
*Assistant Examiner*—Victor K. Hwang
(74) *Attorney, Agent, or Firm*—Norman E. Lehrer

(57) ABSTRACT

A chin and neck exercising device made from foam and which may be in the shape of a ball is disclosed. One half of the ball may be made from one type of foam and the other half of the ball may be made from another type of foam. In this way, different resistance is provided to the person using the device. The device also has a side which is cut-out so that the device is contoured to fit under the person's chin and rest on his or her neck and clavicle. The cut-out area is covered with fabric so as to provide a better grip and to prevent perspiration from contacting the ball. Various exercises may performed by the person in order to tone and strengthen his or her chin and neck muscles. While the device has been described as being formed in the shape of a ball, other sizes and shapes may be used. In an alternative embodiment, the exerciser may include a vibrator located therein.

23 Claims, 2 Drawing Sheets

CHIN AND NECK EXERCISER WITH A VIBRATOR

CROSS-REFERENCE TO RELATED APPLICATIONS

This application is a Continuation-In-Part of U.S. patent application Ser. No. 09/016,778, filed Jan. 30, 1998, now U.S. Pat. No. 5,971,890 which claims the benefit of U.S. Provisional Patent Application Serial No. 60/065,414, filed Nov. 12, 1997.

BACKGROUND OF THE INVENTION

The present invention is directed toward a chin, neck, and face exerciser and more particularly, toward a device which improves muscle tone in the chin and neck areas.

As people become older their bodies start to change. One typical sign of change is sagging and flabby skin in the chin and neck areas. Such a condition is the result of underlying muscles losing their tone due to aging and/or lack of proper exercise. The muscles elongate and droop or sag. This condition also causes wrinkles.

One way of controlling this condition is cosmetic surgery commonly known as a "face-lift." This procedure is effective in tightening facial skin. However, as a result of such tightening, the skin must support the underlying muscle. If this muscle lacks tone, it is lengthened and becomes droopy. Since the skin is not adapted to support the underlying muscles, this creates an even stronger tendency for the skin to droop. While such a method is a quick fix, it is temporary. That is, the process of drooping and wrinkling gradually starts again and the surgery must be repeated. Furthermore, this surgical procedure does not strengthen or tone muscles.

Exercise is one well known way which is effective in toning and strengthening muscles in the arms and legs. The same is also effective in strengthening the muscles of the chin and neck. Besides which, exercising provides long-term results, is inexpensive, simple, and healthier than cosmetic surgery.

U.S. Pat. No. 5,556,357 discloses a face, neck, and chin exerciser where the device includes an elastic member placed within a person's mouth. The mouth is exercised through the use of tension. That is, when the mouth is moved into various positions, for example, an "O" shape and a smile, the elastic member changes the degree of tension and thereby exercises the muscles in the face, chin, and neck. Various exercise routines may be used with this device. This device, however, is invasive and may irritate the person's gums and the insides of his or her mouth.

SUMMARY OF THE INVENTION

The present invention is designed to overcome the deficiencies of the prior art described above and to provide an exercising device which isolates, tones, strengthens, and firms the muscles of the chin, neck, and face.

It is a further object of the invention to provide an exercising device which is portable and easy to use.

In accordance with the illustrative embodiments, demonstrating features and advantages of the present invention, there is provided an exerciser which is made from foam and may be in the shape of a ball where one half of the ball may be made from one type of foam and the other half may be made from another type of foam, thereby providing different resistances. The ball also has a cut-out portion contoured to fit under a person's chin and rest on his or her neck and clavicle. The cut-out portion may be covered with some type of fabric.

In an alternative embodiment, the exerciser may include a vibrator located therein.

Other objects, features, and advantages of the invention will be readily apparent from the following detailed description of preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
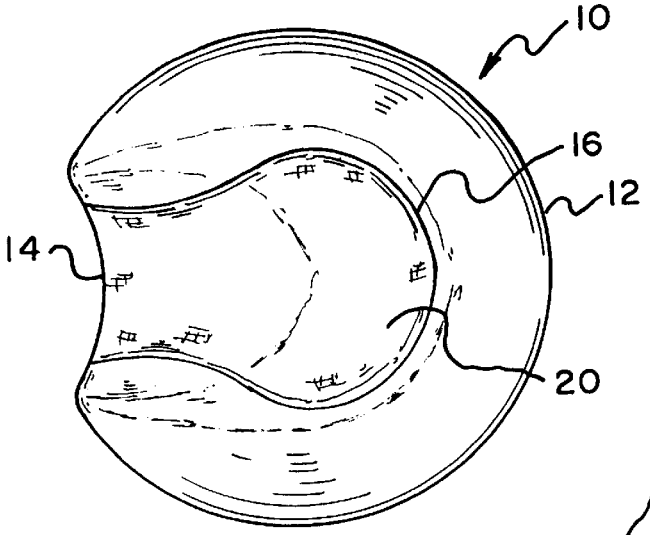
FIG. 1 is a top plan view of the present invention.

Referring now to the drawings in detail wherein like reference numerals have been used throughout the various figures to designate like elements, there is shown in FIG. 1 an exerciser constructed in accordance with, the principles of the present invention and designated generally as 10.

Figure 2:
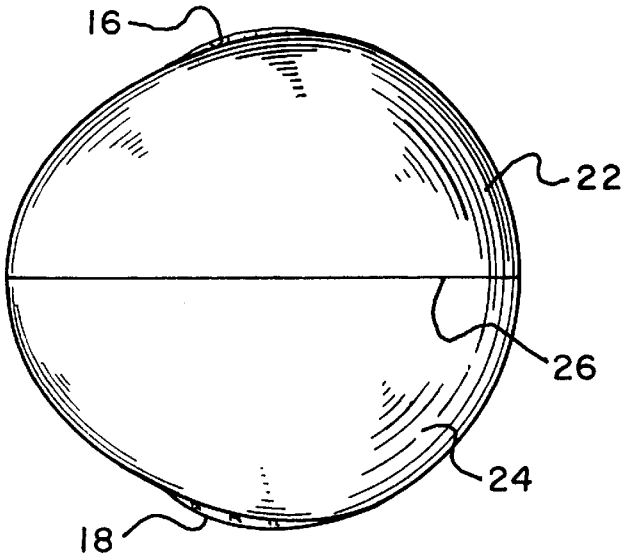
FIG. 2 is side view of the present invention.

For purposes of illustration, the device is shown and will be described as being a ball. However, it should be noted that the device may be formed in any shape, such as a square or rectangle, and any size. The ball 12 is made from foam. (The types of foam used is discussed in more detail below.) The ball has a cut-out or contoured side 14 which is shaped to fit below a person's chin and rest on his or her neck and clavicle. (See FIG. 3.) FIG. 1 shows the top 16 of the contoured side which fits under a person's chin. Although not shown, the contour 14 continues and is similarly shaped on the bottom of the ball so that the ball 12 fits easily within the area indicated above. FIG. 2 shows a side view of the bottom 18 of the contour.

The cut-out side 14 may be covered with fabric 20 so that the skin of the exerciser does not come into direct contact with the foam material. In this way, the fabric 20 prevents perspiration from contacting the foam part of the ball. Also, because the ball 12 is smooth, it may not provide the exerciser with a good grip while exercising. The fabric 20 also provides a grip for the exerciser. The fabric may be of substantially any type of material and color.

The ball 12 has a top half 22 and a bottom half 24 which are joined together at a seam 26. The top half 22 may be formed with one type of foam and the bottom half 24 may be formed from another type of foam. In this manner, different resistance is provided so that, depending upon the needs and strength of the exerciser, either or both halves may be used. For example, the top half 22 may be made of a soft foam and the bottom half 24 may be firmer or more rigid. Also, the ball 12 may be constructed of either open or closed cell foam and one half can be made of one type and the second half of the other type of foam in order to create two different resiliencies. The ball 12 is resilient so that it may be used to perform various exercises as explained below. That is, the ball 12 may be compressed while performing the exercises, but will return to its original shape once it is released.

Figure 3:
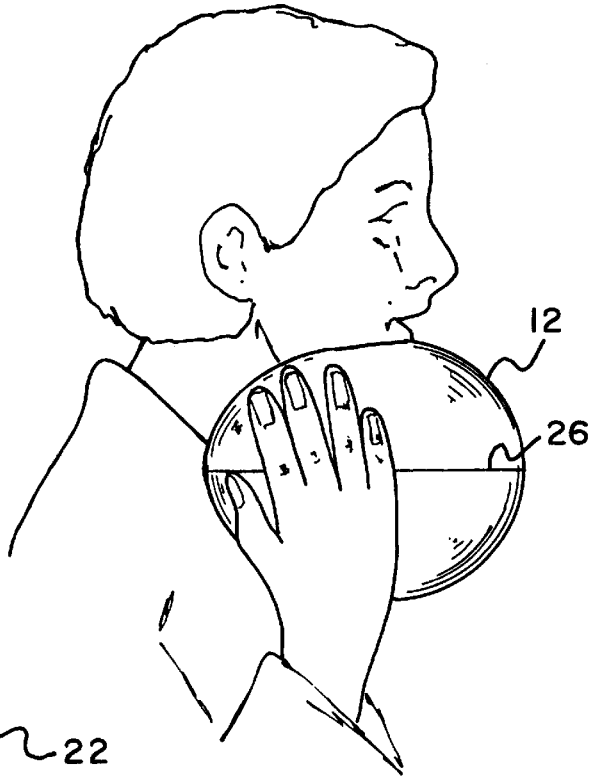
FIG. 3 is schematic representation of the present invention being used by a person.

In order to use the device, the exerciser grips the ball on opposite sides of the ball with his or her hands, as seen in FIG. 3. When first starting to exercise, it would be beneficial to use the half of the ball with less resistance as the top half. The exerciser takes a deep breath and relaxes the muscles of the face and neck. Next, the exerciser tilts his or her head back and raises the chin. The ball is positioned with the chin resting on the top half, the front or contoured side on the neck, and the bottom side resting against the chest. The chin is slowly lowered to the count of four as the exerciser exhales. The position is held for a moment and then the chin is returned to the starting position. This exercise may be repeated five times. As the exerciser feels the exercise becoming easier to perform, the repetitions should be increased to ten. Also, the ball may be turned upside down so that the half of the ball with increased resistance is positioned under the exerciser's chin.

In the second exercise, the exerciser takes a deep breath and relaxes the muscles of the face and neck. The ball is positioned as in the first exercise. The head is held in a fixed position and the mouth is slowly opened by pushing down with the lower jaw to compress the ball. The jaw should be lowered to the count of four as the exerciser exhales. The position is held for a moment and then the mouth is closed in order to return to the starting position. This exercise may be repeated five times. As the exerciser feels the exercise becoming easier to perform, the repetitions should be increased to ten. Again, the resistance may also be increased as described above.

In the third exercise, as in the first two, the exerciser takes a deep breath and relaxes the muscles of the face and neck. The ball is positioned as in the first two exercises. The exerciser's head is tilted slightly to the left so that the left cheek rests lightly on the top of the ball. The chin is pressed diagonally and down, toward the left shoulder. The exerciser then slowly returns to the starting position. The exercise is repeated five times. Again, as the exerciser feels the exercise becoming easier to perform, the repetitions should be increased to ten. Also, the resistance may be increased as described above.

The following points should be kept in mind as the exercising device is being used. For one, muscles should never be forced or strained. Also, stretching should be done only to a comfortable limit. This limit should never be exceeded. Exceeding this limit may lead to irritation or injury.

As indicated above, the exerciser 10 may be made in a variety of sizes and shapes. Furthermore, the device may be provided with aroma-therapy scent in order to enhance the exerciser's relaxation and performance of the exercises.

Figure 4:
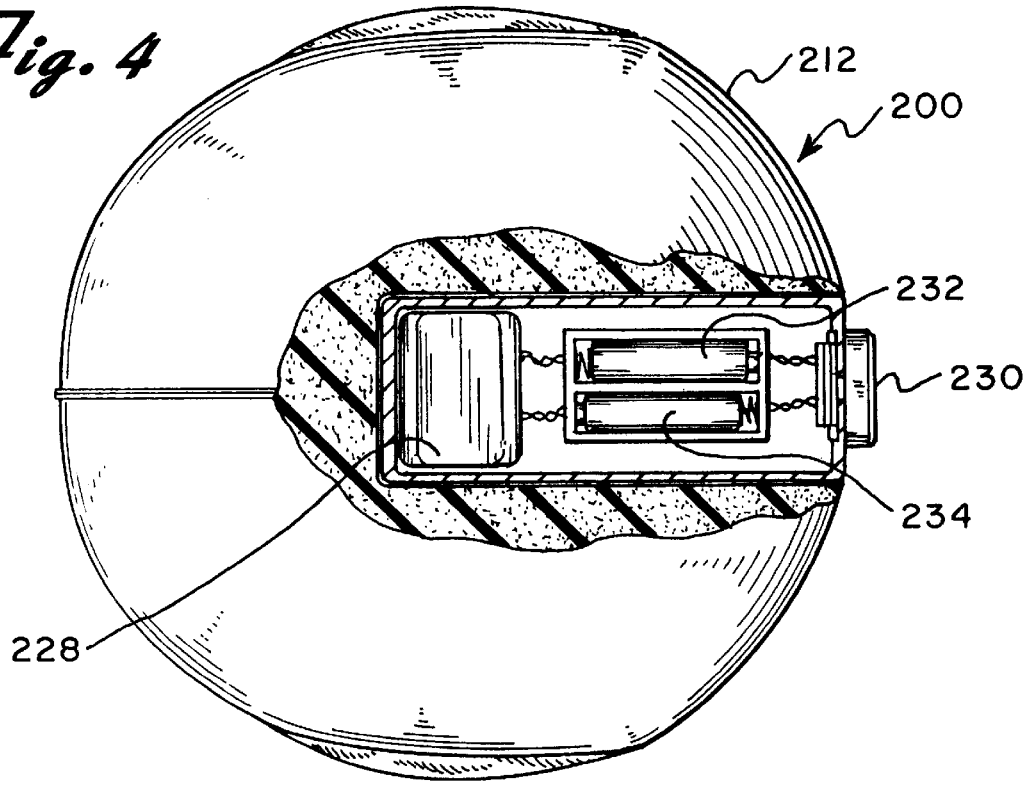
FIG. 4 is a partial cross-sectional view of a second embodiment of the present invention.
Figure 5:
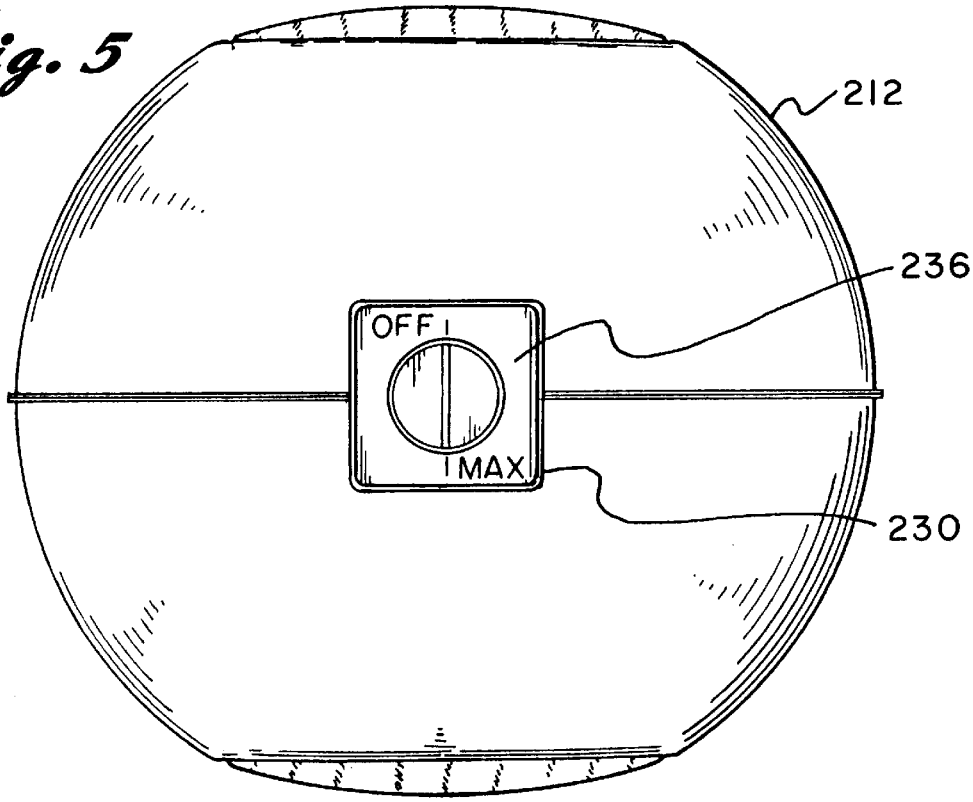
FIG. 5 is an end view of the second embodiment of the present invention.

A second embodiment of the present invention is seen in FIGS. 4 and 5. The exerciser 200 possesses all of the structural features of the exerciser in the first embodiment and will not be repeated here. Also, the exerciser 200 may be used in the same manner described above with regard to the exerciser of the first embodiment.

In this embodiment, however, the resilient member 212 also includes a vibrator or vibrating member 228 which is located therein or is otherwise carried thereby. (It should be realized that while the resilient member 212 is shown as being essentially in the shape of a ball, just as in the first embodiment, the resilient member may be formed in any shape.) The vibrator 228 further includes a control means, which may be a dial 230, located on the exterior surface of the ball 212, seen for example as the rear side of the ball 212 in FIG. 5. The dial 230 is connected to a power source, for example, batteries 232 and 234 which are in turn connected to the vibrator 228. The dial 230 may be used to control the vibrator 228. That is, the dial 230 may be used to turn the vibrator 228 on and has a face plate 236 which indicates various settings of the vibrator 228 so that the user may adjust the vibrator 228 to any desired setting.

The present invention may be embodied in other specific forms without departing from the spirit or essential attributes thereof and accordingly, reference should be made to the appended claims rather than to the foregoing specification as indicating the scope of the invention.

What is claimed is:

1. A chin and neck exerciser comprising a foam member essentially in the shape of a ball having a top half, a bottom half, a side with a cut-out portion, and a vibrator contained therein, said cut-out portion having a top formed on said top half and a bottom formed on said bottom half, said cut-out portion being contoured so that said top fits under a person's chin and said bottom rests on the person's chest.

2. The chin and neck exerciser as claimed in claim 1 wherein said top half is made from a first type of foam and said bottom half is made from a second type of foam so that each of said halves provides a different amount of resistance.

3. The chin and neck exerciser as claimed in claim 2 wherein one of said first and second types of foam is open cell foam and the other of said first and second types of foam is closed cell foam.

4. The chin and neck exerciser as claimed in claim 1 wherein said cut-out portion is covered with fabric.

5. The chin and neck exerciser as claimed in claim 1 further including a power source and means for controlling said vibrator connected to said vibrator.

6. A chin and neck exerciser comprising a resilient member essentially in the shape of a ball having a top half, a bottom half, and a vibrator contained therein, said member being contoured so that one of said halves fits under a person's chin and the other of said halves rests on the person's chest, one of said halves being more resilient than the other of said halves so that each of said halves provides a different amount of resistance.

7. The chin and neck exerciser as claimed in claim 6 wherein said member is contoured so that either of said halves can fit under a person's chin and either of said halves can rest on a person's chest.

8. The chin and neck exerciser as claimed in claim 7 further including cut-out portions at the top and bottom of said top and bottom halves, respectively.

9. The chin and neck exerciser as claimed in claim 8 wherein said member further includes a side and a cut-out portion in said side.

10. The chin and neck exerciser as claimed in claim 9 wherein said cut-out portions are covered with fabric.

11. The chin and neck exerciser as claimed in claim 6 further including a power source and means for controlling said vibrator connected to said vibrator.

12. A chin and neck exerciser comprising a resilient member essentially in the shape of a ball having a top half, a bottom half, and a vibrator contained therein, one of said halves fitting under a person's chin and the other of said halves being adapted to rest on the person's chest, one of said halves being more resilient than the other of said halves so that each of said halves provides a different amount of resistance.

13. The chin and neck exerciser as claimed in claim 12 wherein said member is constructed so that either of said halves can fit under a person's chin and either of said halves can rest on a person's chest.

14. The chin and neck exerciser as claimed in claim 13 further including cut-out portions at the top and bottom of said top and bottom halves, respectively.

15. The chin and neck exerciser as claimed in claim 14 wherein said member further includes a side and a cut-out portion in said side.

16. The chin and neck exerciser as claimed in claim 15 wherein said cut-out portions are covered with fabric.

17. The chin and neck exerciser as claimed in claim 12 further including a power source and means for controlling said vibrator connected to said vibrator.

18. A chin and neck exerciser comprising a resilient member adapted to fit between a person's chin and neck and a vibrating member contained within said resilient member; said resilient member is essentially in the shape of a ball; said ball has a top half and a bottom half, one of said halves fitting under a person's chin and the other of said halves being adapted to rest on the person's chest; and cut-out portions at the top and bottom of said top and bottom halves, respectively.

19. The chin and neck exerciser as claimed in claim 18 wherein one of said halves is more resilient than the other of said halves so that each of said halves provides a different amount of resistance.

20. The chin and neck exerciser as claimed in claim 18 wherein said resilient member is constructed so that either of said halves can fit under a person's chin and either of said halves can rest on a person's chest.

21. The chin and neck exerciser as claimed in claim 18 wherein said resilient member further includes a side and a cut-out portion in said side.

22. The chin and neck exerciser as claimed in claim 21 wherein said cut-out portions are covered with fabric.

23. The chin and neck exerciser as claimed in claim 18 further including a power source and means for controlling said vibrating member connected to said vibrating member.

* * * * *